United States Patent [19]

Beale

[11] 4,151,399

[45] Apr. 24, 1979

[54] HEAT EXCHANGE UNITS

[75] Inventor: David W. B. Beale, Leicester, England

[73] Assignee: Marwin (Holdings) Limited, Leicester, England

[21] Appl. No.: 730,868

[22] Filed: Oct. 8, 1976

[30] Foreign Application Priority Data

Oct. 10, 1976 [GB] United Kingdom ..... 44050/75
Mar. 26, 1976 [GB] United Kingdom ..... 12172/76

[51] Int. Cl.[2] ..... F27D 13/00

[52] U.S. Cl. ..... 219/385; 34/57 A; 219/388; 432/58

[58] Field of Search ..... 219/385, 214, 388, 521; 432/15, 58; 164/12, 16, 22, 200; 165/104 F; 222/146 R, 146 HE, 146 HS, 146 C; 34/57 R, 57 A, 10, 212; 302/53, 40, 13

[56] References Cited

U.S. PATENT DOCUMENTS

| | | | |
|---|---|---|---|
| 413,902 | 10/1889 | Blanchard | 302/40 |
| 915,787 | 3/1909 | Mumford | 432/58 |
| 2,212,120 | 8/1940 | Kneale et al. | 34/10 |
| 2,412,057 | 12/1946 | Nichols | 432/58 |
| 2,550,684 | 5/1951 | Fouquet | 13/25 |
| 2,676,668 | 6/1949 | Lindsay | 34/57 A |
| 2,988,624 | 6/1961 | Iseli-Bossardt et al. | 219/521 |
| 3,029,484 | 4/1962 | Kutny | 34/212 |
| 3,186,102 | 6/1960 | Brociner et al. | 34/10 |

FOREIGN PATENT DOCUMENTS

| | | | |
|---|---|---|---|
| 2003968 | 11/1969 | Fed. Rep. of Germany | 302/40 |

*Primary Examiner*—J. V. Truhe
*Assistant Examiner*—Bernard Roskoski
*Attorney, Agent, or Firm*—Ralph W. Kalish

[57] ABSTRACT

A heat exchange unit for delivery of moulding sand in foundries. The sand is heated or cooled, as desired, by contact in its fluidized state with a heat exchange surface. The delivery temperature may be thermostatically controlled. The unit is capable of intermittent delivery, fluidization ceasing when delivery ceases so that the sand in direct contact with the heat exchange surface insulates the bulk of the sand therefrom. Delivery temperature on recommencement is therefore substantially the same as before cessation. By-pass means may be provided to ensure delivery of sand in the event of malfunction of the unit or during maintenance.

17 Claims, 3 Drawing Figures

HEAT EXCHANGE UNITS

Figure 1:
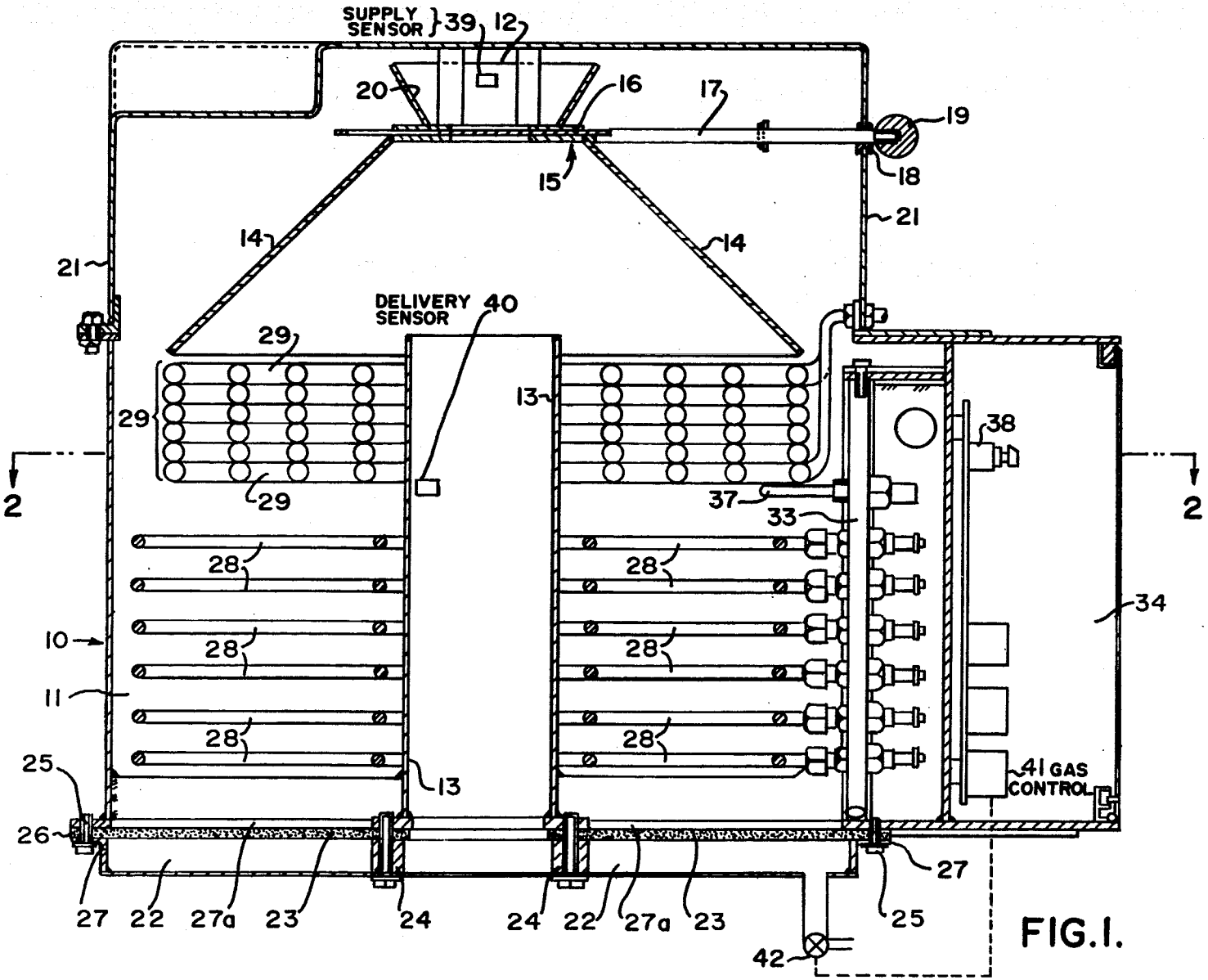

The invention relates to heat exchange units. The invention provides a heat exchange unit for the delivery on intermittent demand of particulate material of low thermal conductivity, the unit comprising a reservoir for the particulate material, an inlet for supply of the particulate material to, and an outlet for delivery of the particulate material from, the reservoir, means for supplying gas to the reservoir to fluidise the particulate material therein, means operable synchronously with cessation of delivery of the particulate material from the outlet to interrupt the gas supply or to reduce the gas supply to an amount insufficient to fluidise the particulate material in the reservoir and with recommencement of delivery to restore the gas supply, and at least one heat exchange surface in or around the reservoir.

In use, the particulate material is supplied to the reservoir through the inlet, fluidised in the reservoir by the gas supply, and delivered from the reservoir through the outlet. There is exceptionally good heat transmission between the heat exchange surface and the particulate material in its fluidised state. When delivery of the particulate material is no longer required, it may be shut off. The synchronously operable means will then interrupt or reduce the gas supply so that the particulate material reverts to a non-fluidized state. Because of the low thermal conductivity of the particulate material there is rapidly established a sharp temperature gradient between the particulate material in direct contact with the heat exchange surface and the remainder of the particulate material. This prevents gross overheating or overcooling of the particulate material during the period of non-delivery.

The heat supplied or withdrawn by the heat exchange surface is preferably controlled by thermostatic means responsive to the temperature of the particulate material. This enables the particulate material to be delivered at a controlled temperature. Upon resumption of delivery after an intermission, the temperature of the delivered particulate material will be substantially the same as prior to the intermission. The thermostatic means may be adjustable so that a selection of the controlled delivery temperature can be made.

The outlet for delivery of the particulate material is preferably an overflow outlet. In this case the delivery of the particulate material from the reservoir will cease whenever the supply of particulate material to the reservoir ceases. The synchronously operable means may therefore be operable synchronously with cessation and recommencement of the supply of the particulate material to the inlet.

The inlet is conveniently directly above the outlet and provided with means for deflecting the supply of particulate material so that it falls under gravity into the reservoir and not directly into the outlet. Then a by-pass for the deflecting means may be provided, so that in the event of malfunction of the unit or during maintenance thereof the by-pass can be operated to allow the particulate material to fall directly into the outlet. Thus a delivery of particulate material, albeit not heated or cooled particulate material, can be maintained during malfunction or maintenance.

The inlet and outlet are preferably centrally disposed with respect to the reservoir, and the means for deflecting the supply of particulate material may be a cone beneath the inlet, onto which cone the supplied particulate material falls. Baffles may be provided on the cone to ensure approximately even distribution of the particulate material to the periphery of the reservoir. The inlet and outlet need not be centrally disposed but could extend from the side walls of the reservoir, or the inlet could be at the top and the outlet extending from a side wall. These embodiments will not, however enable delivery of particulate material during malfunction or maintenance.

Heat exchange surfaces for supplying heat may be provided in a unit according to the invention, or heat exchange surfaces for withdrawing heat may be provided. Preferably both are provided, so that particulate material supplied over-temperature may be cooled before delivery and particulate material supplied under-temperature may be warmed before delivery.

The heat supplying surfaces may be surfaces heated by electricity, gas, solid fuel, steam or otherwise. In one arrangement, the wall of the reservoir can serve as the sole heat supplying surface. Electrical heating elements could surround the wall on its outside, heat loss being reduced by insulation material. The wall could alternatively be heated by gas.

In a convenient alternative arrangement the heat supplying surfaces are casings in which electric filament heaters are disposed. There may, for example, be three vertically arrayed banks of three heaters each in the reservoir. One of the heaters in each bank preferably extends to that part of the reservoir to which the particulate material is initially supplied for example around the periphery of the reservoir when the unit has the preferred central inlet and outlet and cone deflector. The other two heaters in each bank may extend more generally to the body of the reservoir, and this arrangement enables evenness of temperature throughout the particulate material to be optimised. Heat withdrawal surfaces may be pipes through which a coolant fluid circulates, and may be above or below the heaters or may extend between the heaters.

It is preferred that the heat exchange surfaces be de-activated when the particulate material in the reservoir is in its non-fluidised state. By de-activiated, we mean that they are not to supply or withdraw further heat. For example, electrical power to filament heaters would be cut off, or a pump for circulating coolant fluid would be stopped. This helps further to ensure that the delivery temperature of the particulate material will be substantially the same after an intermission in delivery as before that intermisssion.

In the above described preferred arrangement of three banks of three heaters each, the thermostatic means may switch all heaters on or off together as necessary. Finer temperature control will, however, be obtained if only one bank is switched on or off as necessary under thermostatic control. This is preferably the uppermost bank. One or both of the two lower banks is then used for continuous heating if the uppermost bank alone is incapable of the desired temperature increase. The two lower banks would still be switched off during periods of non-fluidisation. Still better control of heat suppled may be obtained if, on resumption of fluidisation the lower banks do not switch on until the uppermost bank switches on. They then remain on until the next cessation of delivery of particulate material, while the uppermost bank switches on and off as appropriate to the need for heat to maintain the constant temperature.

Fine temperature control could also be obtained by use of a variable power input for the heaters.

Fluidisation of the particulate material in the reservoir may be effected by any suitable means. The gas used is preferably air, for obvious reasons of expense. The base of the reservoir may, for example, be a partition permeable to air but not to the particulate material, the partition dividing the reservoir from a windbox beneath the reservoir.

A heat exchange unit according to the invention may handle particulate material at varying throughputs and varying differences between the supply and delivery temperatures of the particulate material. If, however, the desired throughput is greater than may be handled for a given temperature difference, or the desired temperature difference is greater than can be handled for a given throughput, further heat exchange surfaces can be incorporated, suitably connected to the existing electrical and/or plumbing arrangements. The volume of the reservoir can be increased to include these further heat exchange surfaces. For example, the volume of a reservoir having the form of a cylindrical walled container with a central circular overflow outlet tube and an annular permeable partition base may be increased by use of a cylindrical wall extension the bottom rim of which is attachable to the top rim of the container and a circular tube the bottom rim of which is attachable to the top rim of the outlet tube. In this example, the inlet would be in a detachable lid for the reservoir, which would simply be placed on top of the cylindrical wall extension instead of on top of the original reservoir.

Heat exchange units according to the invention are particularly suitable for use in metal foundries, in which sand moulds are used for metal castings. Sand is delivered to mixers in which bonding agents, such as silicates, oil systems and resins, and other additives if desired are incorporated, and from the mixers the sand composition is delivered to moulding boxes in which it "cold-sets", that is bonds together chemically without being baked in an oven or otherwise heated. The pattern is stripped from the moulding box as soon as the "cold-setting" has proceeded enough to give the sand composition sufficient strength. Units according to the invention can be used to deliver sand, on intermittent demand, to the mixers at a known and substantially constant temperature. This has the advantages, first, that more economic use can be made of the chemicals employed and secondly, that the stripping of the pattern can be effected at a known optimal time. For sand for this purpose the preferred adjustable thermostatic means may be adjustable for delivery at a chosen temperature between given limits, for example 18° C. and 25° C.

It should be pointed out that heat exchange units according to the invention, although designed for intermittent delivery of particulate material of low thermal conductivity, are also suitable for continuous delivery of such material or for continuous delivery of particulate material not of low thermal conductivity.

Figure 2:
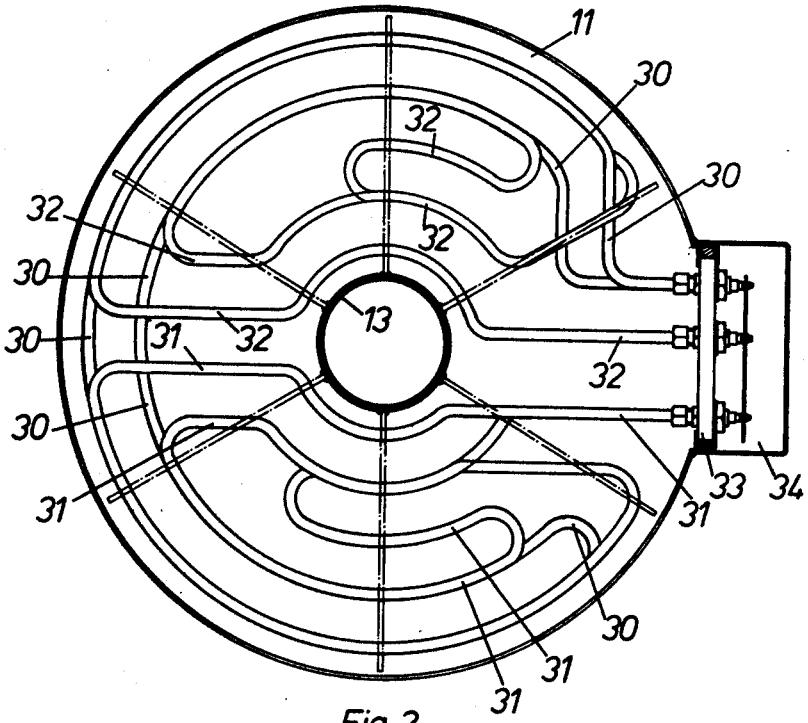
Figure 3:
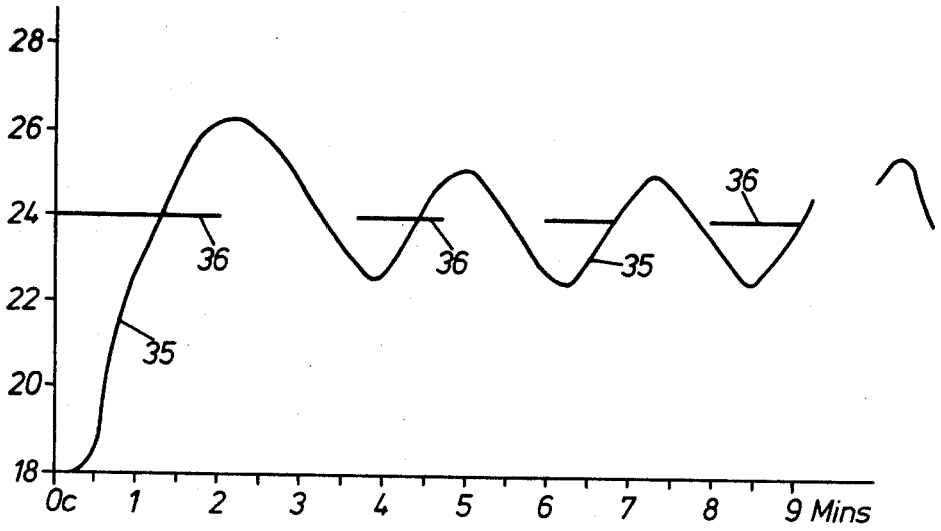

The invention is illustrated with reference to the accompanying drawings, of which:

FIG. 1 ia an axial section through a heat exchange unit according to the invention;

FIG. 2 is a plan view of one of the banks of heating elements in the heat exchange unit of FIG. 1; and FIG. 3 is a plot of temperature against time obtained using a heat exchange unit according to the invention.

With reference to FIG. 1 of the drawings, a heat exchange unit, generally indicated 10, and intended for use with foundry sand, comprises a reservoir 11 for sand, an inlet 12 for supply of the sand to the reservoir 11, and an outlet 13 for delivery of the sand from the reservoir 11. The outlet 13 is an overflow outlet.

The inlet 12 is directly above the outlet 13, both being centrally disposed with respect to the reservoir 11. A cone 14 beneath the inlet 12 enables sand supplied to the latter to be deflected to the periphery of the reservoir 11. The cone 14 is provided with a by-pass 15 comprising a plate 16 usually situated, as indicated in FIG. 1, directly beneath the inlet 12. The plate 16 is attached by a rod 17 passing through a seal 18 to a threaded knob 19 and may be withdrawn from the indicated position by pulling on the knob 19. In the withdrawn position of the plate 16 sand may fall directly from the inlet 12 to the outlet 13. The cone 14 is further provided with a spreader or baffle 20 to ensure approximately even distribution of supplied sand around the periphery of the reservoir 11.

The inlet 12, cone 14 and by-pass 15 are all mounted by a detachable lid 21 of the reservoir 11.

The reservoir 11 is divided from a windbox 22 by an annular nylon partition 23, which is permeable to air but not to sand. The pore size of the nylon partition 23 is such as not to be clogged by the sand. Air may be supplied to the windbox 22 through a pipe (not shown) to fluidise sand in the reservoir 11. The partition 23 is supported at its centre by an annular central member 24, which also supports the outlet 13, and at its periphery by screws 25 linking flanges 26 and 27 of the reservoir 11 and windbox 22. Four ribs 27*a* are also included.

The reservoir 11 is provided with a plurality of heat exchange surfaces comprising three banks each of three heating elements each of 3 kW capacity, these being diagrammatically illustrated at 28 in FIG. 1, and a plurality of cooling pipes 29.

Referring now to FIG. 2, one bank of the heating elements comprises three heating elements 30, 31 and 32. These are supported by a solid block 33 of thermally insulating and electrically insulating material. The heating element 30 extends in a closed loop around the periphery, to which the sand is initially supplied, of the reservoir 11. The heating elements 31 and 32 are of the shape shown, extending more generally through the reservoir 11. The other two banks are similar. The block 33, together with the heating elements 30, 31 and 32, may be removable from the unit for ease of maintenance of the unit or elements.

The supply of electrical power to the heaters 28 and of cooling fluid to the pipes 29 is controlled by switching apparatus 38 located in a box 34 on the side of the reservoir 11. The switching apparatus operates in response to the temperature of the sand in the reservoir 11 to switch on or off the uppermost bank of heaters 28 as appropriate, the other two banks being pre-set to be either on throughout or off throughout the period in which fluidisation occurs. The temperature is sensed by a mercury-in-glass thermometer 37, current being carried through the mercury with wires sealed into the glass for contact with the mercury. Alternative temperature sensing devices, such as thermistors could be used. Additionally the switching apparatus switches off all heaters 28 or the pump (not shown) for the cooling fluid and the pump (not shown) for the air supply when supply of sand to the inlet 12 ceases.

Flow sensors 39 and 40 responsive to cessation of supply of sand and cessation of delivery of sand, respectively, are suitably interconnected with a control 41 for a gas supply valve 42 for providing the aforesaid means operable synchronously with cessation of delivery of the particulate material from the outlet to interrupt the gas supply or to reduce the gas supply to an amount insufficient to fluidise the particulate material in the reservoir and with recommencement of delivery to restore the gas supply.

FIG. 3 shows the operation of a heat exchange unit according to the invention by a plot of delivery temperature against time. The initial temperature is 18° C. and the desired delivery temperature is 24° C. The continuous line 35 is the plot and the broken line 36 shows when the heaters were switched on. Initial heating took the temperature to 26.4° C. in two minutes after which the heaters were on intermittently only and the temperature remained within 1½° C. of the desired temperature. After 9.2 minutes delivery was interrupted for one minute and then resumed. On resumption the temperature was ½° C. above that at which interruption occured, rose to 25.6° C. and then settled back to normal. Although not shown in the plot, similar performances have been recorded for interruptions of considerably longer periods, including periods exceeding 30 minutes.

I claim:

1. A heat exchange unit for the delivery on intermittent demand of particulate material of low thermal conductivity comprising means defining a reservoir for particulate material comprising a base portion, upstanding side portions, and a top closure, said base portion being gas permeable, said reservoir having an inlet for supply of particulate material thereto, said reservoir also having an outlet for delivery of particulate material therefrom, means for supplying gas to the reservoir through the gas permeable base portion to fluidise the particulate material therein, at least one heat transfer member in said reservoir having a surface arranged to be in heat exchange relationship with the particulate material, means for connecting the heat transfer member to an energy source for varying the temperature of said surface, and means operable synchronously with cessation of delivery of particulate material from the reservoir outlet to reduce the gas supply to the said reservoir to an amount insufficient to fluidise the particulate material in the reservoir, whereby the bulk of the particulate material remaining in said reservoir is thermally insulated from the heat transfer member by the low thermal conductivity of the particulate material adjacent the heat transfer member, and with recommencement of delivery of the particulate material to the reservoir outlet to restore the gas supply to an amount sufficient for fluidisation, whereby the particulate material then delivered is at substantially the same temperature as the particulate material delivered prior to the gas supply reduction and restoration.

2. A unit according to claim 1 in which the outlet is an overflow outlet.

3. A unit according to claim 2 in which the synchronously operable means are operable synchronously with cessation of supply of the particulate material to the reservoir inlet to reduce the gas supply to an amount insufficient to fluidise the particulate material in the reservoir and with recommencement of supply of the particulate material to restore the gas supply to an amount sufficient for fluidisation of said particulate material.

4. A unit according to claim 1 in which the reservoir inlet is directly above the outlet, means provided below said inlet for deflecting the supply of particulate material from the reservoir inlet so that it falls under gravity into the reservoir and not directly into the outlet, and means associated with the deflecting means for optional bypass of the deflecting means to allow the particulate material to fall under gravity directly into the outlet.

5. A unit according to claim 4 in which the inlet and the outlet are disposed centrally with respect to the reservoir and the deflecting means is such as to direct the supplied particulate material to the periphery of the reservoir.

6. A unit according to claim 5 in which the deflecting means is of frusto-conical contour and disposed beneath the inlet for receiving the supplied particulate material as such falls from the inlet.

7. A unit according to claim 6 in which baffles are provided on the deflecting means to ensure approximately even distribution of the particulate material to the periphery of the reservoir.

8. A unit according to claim 1 in which the at least one heat transfer member comprises at least one electrically heated element and having a power connection thereto.

9. A unit according to claim 8 in which, when the particulate material is in its non-fluidized state, power is supplied to none of the electrically heated elements.

10. A unit according to claim 9 and further comprising thermostatic means responsive to the temperature of the particulate material for controlling the power connections to the said at least one electrically heated element (s) thereby to control the delivery temperature of the particulate material.

11. A unit according to claim 10 in which the thermostatic means is adjustable for selection of the controlled delivery temperature of the particulate material.

12. A unit according to claim 10 in which there is a plurality of electrically heated elements in the reservoir, and means whereby only preselected ones of said elements are controlled by the thermostatic means.

13. A unit according to claim 12 in which at least one other of the electrically heated elements is adapted to be switched on by the thermostatic means but switched off only when the particulate material reverts to its non-fluidised state.

14. A unit according to claim 13 in which at least one other of the electrically heated elements is adapted to be switched on whenever the particulate material is in its fluidised state.

15. A unit according to claim 12 in which a block of thermally insulating and electrically insulating material supports the plurality of electrically heated elements in the reservoir, and the block and electrically heated surfaces are adapted to be removable from the reservoir.

16. A unit according to claim 1 in which at least one heat transfer member comprises at least one pipe for the circulation of a coolant fluid.

17. A unit according to claim 16 in which the circulation of the coolant fluid is stopped when the particulate material is in its non-fluidised state.

* * * * *

UNITED STATES PATENT OFFICE

CERTIFICATE OF CORRECTION

Patent No. 4,151,399 Dated April 24, 1979

Inventor(s) David W. B. Beale

It is certified that error appears in the above-identified patent and that said Letters Patent are hereby corrected as shown below:

Claim 15, line 5, delete "surfaces" and insert ---elements---.

Signed and Sealed this

Thirty-first Day of July 1979

[SEAL]

Attest:

Attesting Officer

LUTRELLE F. PARKER
Acting Commissioner of Patents and Trademarks